US010343001B2

(12) United States Patent
Seman

(10) Patent No.: US 10,343,001 B2
(45) Date of Patent: Jul. 9, 2019

(54) FALL PROTECTION LANYARD CAPABLE OF DIRECT CONNECTION TO HARNESS WEBBING

(71) Applicant: Honeywell International Inc., Morris Plains, NJ (US)

(72) Inventor: Michael R. Seman, Cranberry Township, PA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 15/698,256

(22) Filed: Sep. 7, 2017

(65) Prior Publication Data

US 2019/0070444 A1 Mar. 7, 2019

(51) Int. Cl.
*A62B 35/04* (2006.01)
*A62B 35/00* (2006.01)

(52) U.S. Cl.
CPC ..... *A62B 35/0043* (2013.01); *A62B 35/0037* (2013.01); *A62B 35/0075* (2013.01); *A62B 35/04* (2013.01)

(58) Field of Classification Search
CPC ..... A62B 35/0043; A62B 35/0037; A62B 35/0075; A62B 35/04
See application file for complete search history.

(56) References Cited

U.S. PATENT DOCUMENTS 3,762,507 A * 10/1973 Starr ..... A62B 35/04 182/4
3,937,407 A * 2/1976 Matsuo ..... A62B 35/04 244/151 R
4,253,544 A * 3/1981 Dalmaso ..... A62B 35/04 182/18
5,143,187 A * 9/1992 McQuarrie ..... A62B 35/0056 182/3
5,220,977 A * 6/1993 Wolner ..... A62B 35/0037 182/18
5,400,868 A * 3/1995 Ellis ..... A63C 11/00 182/18

(Continued)

OTHER PUBLICATIONS

Miller® TurboLite™ Edge Personal Fall Limiters (Honeywell) dated Apr. 27, 2017.

(Continued)

*Primary Examiner* — Colleen M Chavchavadze
(74) *Attorney, Agent, or Firm* — Alston & Bird LLP

(57) ABSTRACT

A fall arrest lanyard (10) is provided for arresting the fall of a user from an elevated worksite and includes a connector (16) having a rigid frame (30) and a load bearing pin (32) extending along a longitudinal axis (34). The pin (32) has a central span (36) extending between first and second end portions (38, 40) and is mounted in the frame (30) to translate along the longitudinal axis (34) between an open position wherein at least one of the end portions (38, 40) is spaced from the frame (30) to allow a length of webbing (41) from a fall protection harness (17) to be loaded into the connector (16), and a closed position wherein the first and second end portions (38, 40) of the pin (32) are supported by the frame (30) with the central span (36) of the pin (32) being free from engagement to trap the length of webbing (41) between the pin (32) and the frame (30) for load bearing engagement with the central span (36).

9 Claims, 5 Drawing Sheets

(56) References Cited

U.S. PATENT DOCUMENTS

| | | | | |
|---|---|---|---|---|
| 7,073,627 | B2 * | 7/2006 | Casebolt | A62B 35/0031 119/770 |
| 7,178,632 | B2 * | 2/2007 | Casebolt | A62B 35/0037 119/770 |
| 8,177,025 | B2 * | 5/2012 | Lang | A62B 35/0018 182/3 |
| 8,276,712 | B2 | 10/2012 | Smith et al. | |
| 8,375,467 | B2 * | 2/2013 | Real | A41D 13/0007 2/69 |
| 8,675,823 | B2 * | 3/2014 | Hooten | A62B 35/04 182/3 |
| 9,273,717 | B2 * | 3/2016 | Schlangen | F16B 45/02 |
| 9,427,608 | B2 * | 8/2016 | Fink | A62B 35/0037 |
| 9,435,484 | B1 * | 9/2016 | Yang | F16B 45/04 |
| 9,585,439 | B2 * | 3/2017 | Casebolt | A62B 35/0037 |
| 9,643,034 | B2 * | 5/2017 | Wise | A62B 35/0075 |
| 9,704,370 | B2 * | 7/2017 | Ulner | G08B 21/0446 |
| 2009/0071750 | A1 * | 3/2009 | Simard | A62B 1/14 182/5 |
| 2009/0211849 | A1 * | 8/2009 | Smith | A62B 35/0037 182/231 |
| 2012/0067666 | A1 * | 3/2012 | Smith | A62B 35/04 182/3 |
| 2016/0130875 | A1 | 5/2016 | Hwang | |
| 2016/0220857 | A1 * | 8/2016 | Rappoport | A62B 35/0075 |
| 2016/0361577 | A1 * | 12/2016 | Perner | A62B 35/0037 |
| 2017/0291046 | A1 * | 10/2017 | Bouquier | A62B 35/0018 |
| 2017/0319907 | A1 * | 11/2017 | Crawford | A62B 35/0037 |

OTHER PUBLICATIONS

3101253 DBI Sala Nano-Lok with Single Leg Harness Connector and Swiveling Snap Hook (Fall Protection) dated Apr. 27, 2017.

* cited by examiner

FALL PROTECTION LANYARD CAPABLE OF DIRECT CONNECTION TO HARNESS WEBBING

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

This disclosure relates to fall protection in fall arrest systems, and more particularly, to fall protection/fall arrest lanyards.

BACKGROUND

Fall protection/fall arrest lanyards are well known. Conventionally, such lanyards employ snap hooks at both ends, with one of the snap hooks intended to connect to the D-ring of a user's harness and the other snap hook intended to connect to an anchor point. While such lanyards have proved very suitable for their intended function, there is always room for improvement.

It is known to utilize a connector in combination with an energy absorber that allows a self-retracting lifeline to be fixed to a D-ring of the connector, while the connector itself is fixed to a length of webbing in a user's harness adjacent the D-ring of the harness. The D-ring of the connector separates from the connector under a predetermined load so that the energy absorber can absorb the energy of a user's fall.

SUMMARY

In accordance with one feature of the invention, a fall arrest lanyard is provided for arresting the fall of a user from an elevated worksite. The fall arrest lanyard includes a first connector at a first end of the lanyard to connect the lanyard to an anchor point, a second connector at a second end of the lanyard to connect the fall arrest lanyard to a harness worn by a user, and a length of flexible, load bearing, lanyard material extending between the first and second ends. The second connector includes a rigid frame and a load bearing pin extending along a longitudinal axis. The pin has a central span extending between first and second end portions and is mounted in the frame to translate along the longitudinal axis relative to the frame between an open position wherein at least one of the end portions is spaced from the frame to allow a length of webbing from a fall protection harness to be loaded into the connector for engagement with the central span of the pin and a closed position wherein the first and second end portions of the pin are supported by the frame with the central span of the pin being free from engagement to trap the length of webbing between the pin and the frame for load bearing engagement with the central span.

As one feature, the length of flexible, load bearing, lanyard material is a length of webbing.

In one feature, the length of flexible, load bearing, lanyard material extends from the first end connector to the second connector, with an end portion of the material fixed to the first end connector and an opposite end portion fixed to the second connector.

According to one feature, the lanyard further includes an energy absorber, the energy absorber having an end fixed to the second connector and another end fixed to the length of flexible, load bearing, lanyard material.

As one feature, the first connector includes a snap hook.

In one feature, the rigid frame includes an H-shaped bracket having a cross-bar portion extending between two leg portions, one of the leg portions supporting the first end portion of the pin and the other of the legs supporting the second end portion of the pin in the closed position.

According to one feature, the each of the leg portions has a bore receiving the corresponding end portion of the pin.

As one feature, the pin is a cylindrical pin and the bores are cylindrical bores.

In one feature, the leg portions extend parallel to each other and perpendicular to the cross-bar portion.

According to one feature, the cross-bar portion and the pin extend parallel to each other.

As one feature, the second connector further includes a ring fixed to the rigid frame.

In one feature, the ring is fixed to each of the leg portions.

According to one feature, the lanyard further includes an energy absorber having an end fixed to the ring and another end fixed to the length of flexible, load bearing, lanyard material.

As one feature, the length of flexible, load bearing, lanyard material has an end fixed to the ring and an opposite end fixed to the first connector.

In one feature, the ring is fixed to each of the legs by shear pins that break when subjected to forces that exceed a predetermined load on the ring, and further comprising an energy absorber having an end fixed to the cross-bar portion and another end fixed to the ring.

According to one feature, the lanyard further includes another length of flexible, load bearing, lanyard material, having an end fixed to the ring and an opposite end fixed to a third connector.

Other features and advantages will become apparent from a review of the entire specification, including the appended claims and drawings.

DETAILED DESCRIPTION

Figure 2:
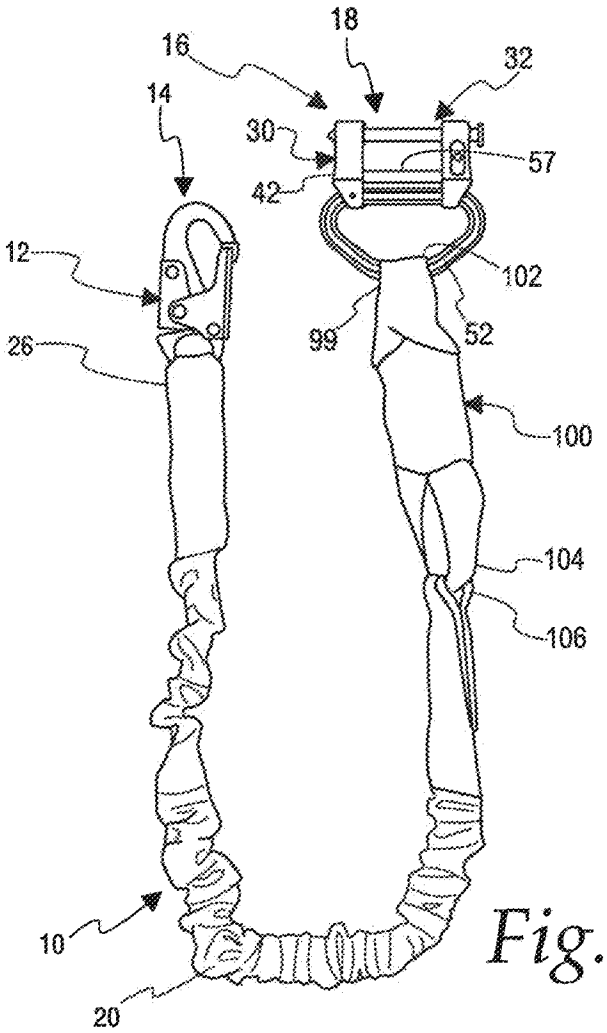
FIGS. 1-4 are illustrations of fall arrest lanyards according to this disclosure.

With reference to FIGS. 1-4, four embodiments of a fall arrest lanyard 10 according to this disclosure are illustrated, with each of the embodiments including a first connector 12 at the first end 14 of the lanyard 10 to connect the lanyard to an anchor point, a second connector 16 at a second end 18 of the lanyard 10 to connect the lanyard 10 to a harness 19 (only partially shown in FIG. 1) worn by a user, and a length of flexible, load bearing lanyard material 20 extending between the first and second ends 14 and 18. For the embodiment shown in FIG. 4, the lanyard 10 further includes another length of flexible, load bearing, lanyard material 22 and a third connector 24 to connect the lanyard 10 to an anchor point. In the illustrated embodiments, the first connector 12 and the third connector 24 are shown in the form of snap hook connectors as are commonly employed in fall arrest lanyards, but it should be understood that any suitable connector for attaching the lanyard to an anchor point can be utilized for the fall arrest lanyard 10 according to this disclosure and that no limitation to a specific type of connector is intended unless expressly recited in one of the appended claims. In each of the illustrated embodiments, the length of flexible, load bearing lanyard material is provided in the form of a length of webbing having a looped end 26 fixed to the first connector 12, as is conventional. While webbing will be desirable in many applications, it should be understood, that the length of flexible, load bearing, lanyard material 20,22 can be any suitable material, many of which are known for use in fall arrest lanyards.

Figure 8:
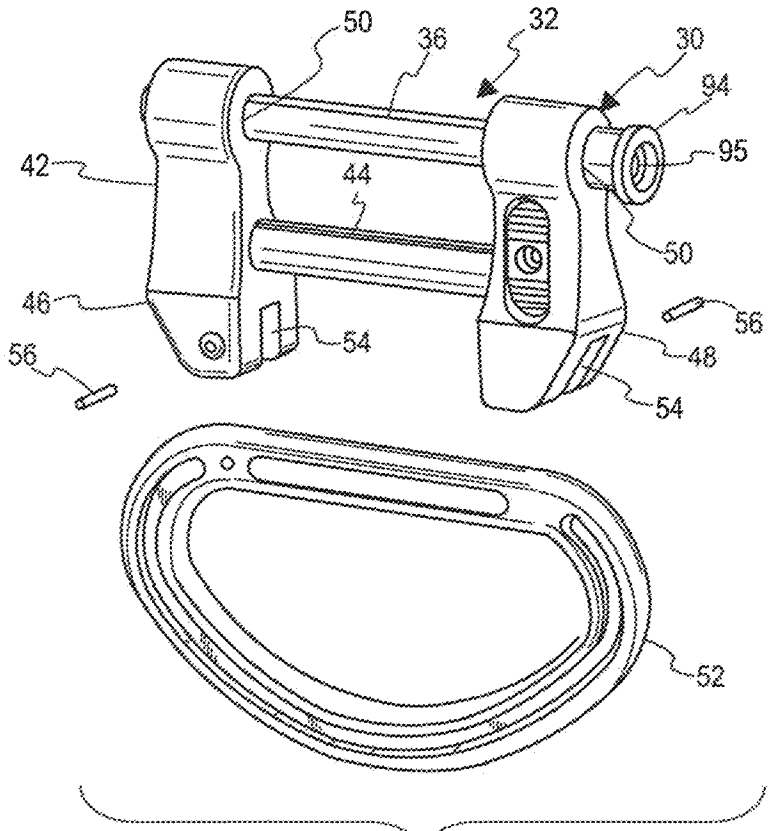
FIG. 8 is a partially exploded, perspective view from the right of the connector of FIGS. 5-7.
Figure 7:
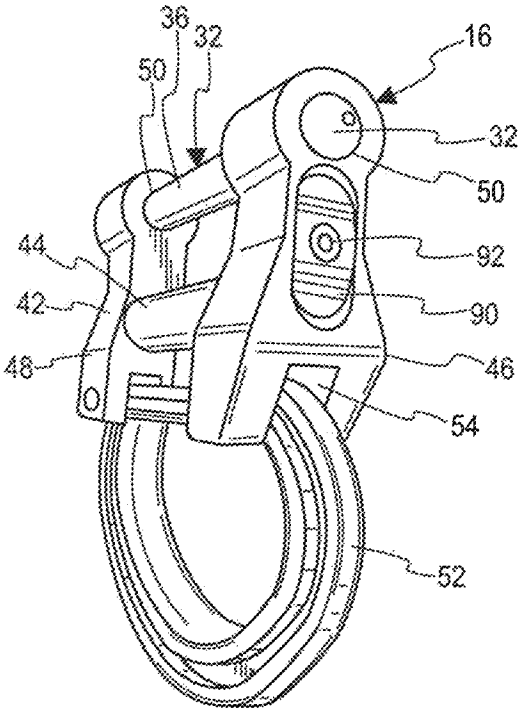
FIG. 7 is a perspective view from the left of the connector of FIGS. 5 and 6.
Figure 9:
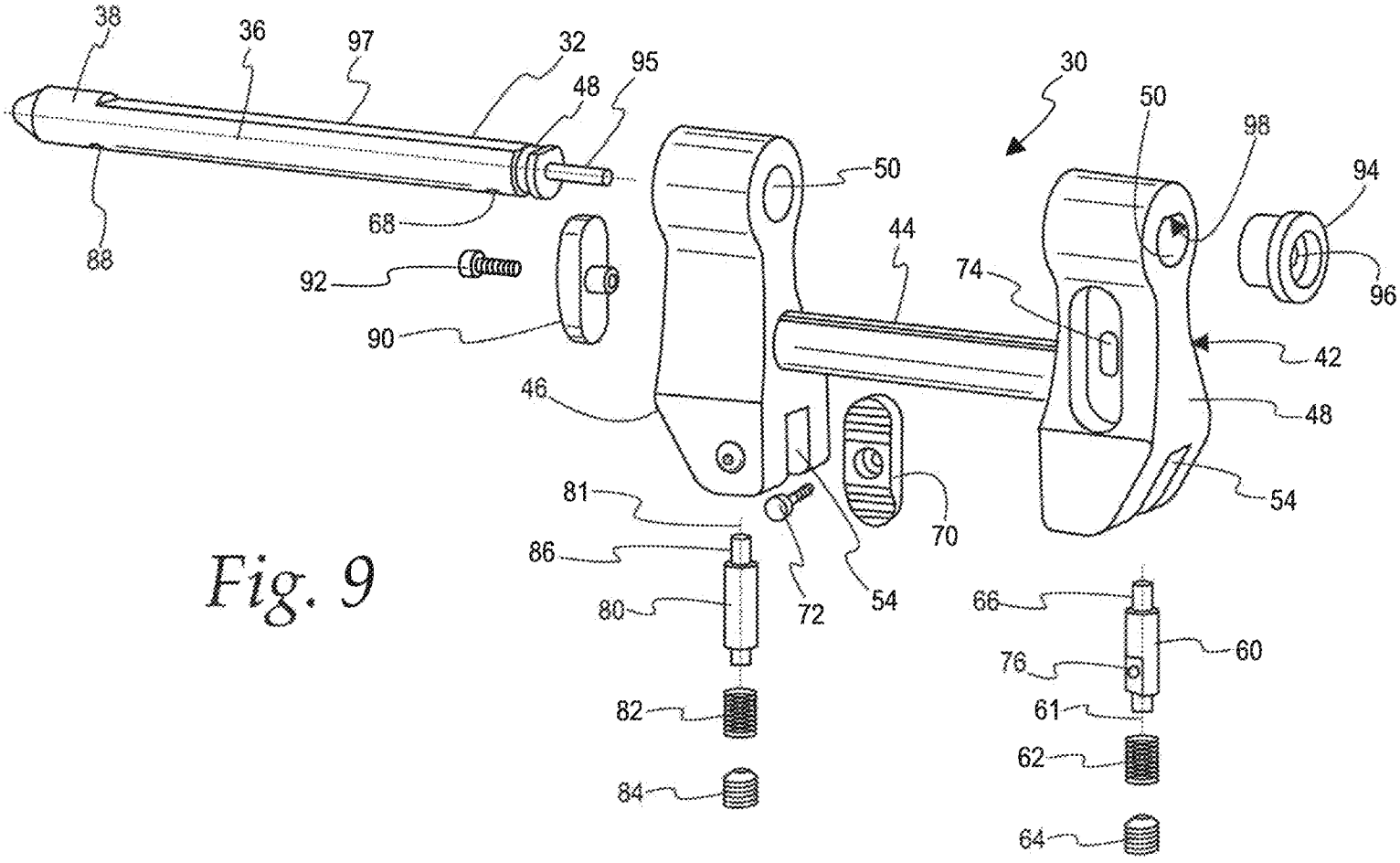
FIG. 9 is an exploded view of selected components of the connector of FIGS. 5-8.

As best seen in FIGS. 5-9, the second connector 16 includes a rigid frame 30, and a load bearing pin 32 extending along a longitudinal axis 34. The pin 32 has a central span 36 extending between first and second end portions 38 and 40. The pin 32 is mounted in the frame 30 to translate along the longitudinal axis 34 relative to the frame 30 between an open position, shown in FIG. 6, wherein the end portion 40 is spaced from the frame 30 to allow a length of webbing 41 (two lengths of webbing 41 shown in FIG. 1) from a fall protection harness 19 to be loaded into the connector 16 for engagement with the central span 36 of the pin 32, and a closed position, shown in FIGS. 1-5, wherein the first and second end portions 38 and 40 of the pin 32 are supported by the frame 30 with the central span 36 of the pin 32 being free from engagement to trap the length of webbing 41 between the pin 32 and the frame 30 for load bearing engagement with the central span 36. The rigid frame 30 includes an H-shaped bracket 42 having a cross-bar portion 44 extending between two leg portions 46 and 48, with the leg portion 46 supporting the end portion 38 of the pin 32 and the other leg portion 48 supporting the end portion 40 of the pin 32 with the pin 32 in the closed position. In this regard, as best seen in FIG. 9, each of the leg portions 46 and 48 has a cylindrical bore 50 receiving the corresponding end portion 38 and 40 of the pin 32. In the illustrated embodiment, the leg portions 46 and 48 extend parallel to each other and perpendicular to the cross-bar portion 44. In the illustrated embodiment, the frame 30 further includes a D-ring 52 fixed to the H-shaped bracket 42. In this regard, as best seen in FIG. 8, each of the leg portions 46 and 48 includes an open slot 54 into which a corresponding portion of the D-ring 52 is received, with a cylindrical pin 56 fixed in each of the corresponding leg portions 46 and 48 and extending through the corresponding portion of the D-ring 52 to fix the D-ring 52 in the slot 54. While the cross-bar portion 44 will be desirable in many applications, in some applications the frame 30 may not have a cross-bar portion 44, as shown by the frame 30 in FIG. 2, wherein the bracket 42 has a U-shape with a cross-bar portion 57 and the ring 52 being formed as unitary portions of the bracket 42.

The second connector 16 also includes features that allow the load bearing pin 32 to be locked in the closed and open positions. In this regard, as best seen in FIG. 9, in the illustrated embodiment, a spring loaded, cylindrical, detent pin 60 is received for sliding translation along its longitudinal axis 61 in a conforming bore formed in the leg portion 48. A helical spring 62 and a threaded retainer 64 are also received in the bore of the leg portion 48, with the threaded retainer 64 serving to retain the spring 62 and the pin 60 in the leg portion 48 and to preload the spring 62 so that an end 66 of the pin 60 engages a detent recess 68 formed in the load bearing pin 32 to prevent the load bearing pin 32 from translating along the axis 34 relative to the frame 30. A user operated finger slide 70 is attached to the detent pin 60 via a threaded fastener 72 that extends through a slot 74 formed in the leg portion 48 to engage a threaded bore 76 in the detent pin 60. The slide 70 allows a user to move the pin 60 from the engaged position to a disengaged position wherein the end 66 is disengaged from the detent recess 68 to allow the load bearing pin 32 to be translated relative to the frame 30 along the longitudinal axis 34. Similarly, a detent pin 80 is received for sliding translation in a conforming bore formed in the leg portion 46 for translation along the longitudinal axis 81 of the pin 80. A helical spring 82 and a threaded retainer 84 are also received in the bore, with the threaded retainer 84 retaining the pin 80 and the spring 82 in the bore and preloading the spring 82 so that an end 86 of the detent pin 80 engages a detent recess 88 in the load bearing pin 32 with the pin 32 in the closed position. A user operated finger slide 90 is fixed to the detent pin 80 using a threaded fastener 92 that extends through a slot (not shown, but identical in shape to the slot 74 in the leg portion 48) in the leg portion 46 to engage a threaded bore (not shown, but identical to the bore 76 in the detent pin 60). The detent pin 60 in the leg portion 48 also engages the detent recess 88 in the load bearing pin 32 with the pin 32 in the open position to retain the pin 32 in the open position. While the detent pins 60 and 80 and associated features (62-76, 82-92) are desirable in many applications, it should be understood that other suitable user operated detents or retainers may prove desirable in other applications, and that no limitation to a specific detent/retainer is intended unless expressly recited in an appended claim.

As best seen in FIG. 9, in the illustrated embodiment, the pin 32 includes a user graspable head 94 that is fixed to the remainder of the pin 32 by a cylindrical post 95 that has an interference fit in a receiving bore 96 formed in the head 94 and then peened to prevent separation from the remainder of the pin 32. The illustrated embodiment also includes anti-rotation features in the form of a flat, elongate surface 97 formed on the pin 32 that slides against an flat surface 98 formed in the bore 50 in the leg 48. While the illustrated features for the pin 32 will be desirable for many applications, it should be understood that this disclosure contemplates other suitable forms for the pin 32. For example, the pin 32 could a non-cylindrical shape. As another example, the pin 32 could be formed as a one-piece, unitary component with the head 94 being part of that unitary component. As another example, in some applications, the pin 32 and the bore 50 in the leg portion 48 may not require the flats 97 and 98, respectively. As yet another example, the recess 68 and 88 could be provided in the form of annular grooves that extend around the entire circumference of the pin 32 rather than the localized recesses 68 and 88 of the illustrated embodiments. Accordingly, it should be understood that no limitations to specific features or forms of the pin 32 are intended unless expressly recited in an appended claim.

Figure 1:
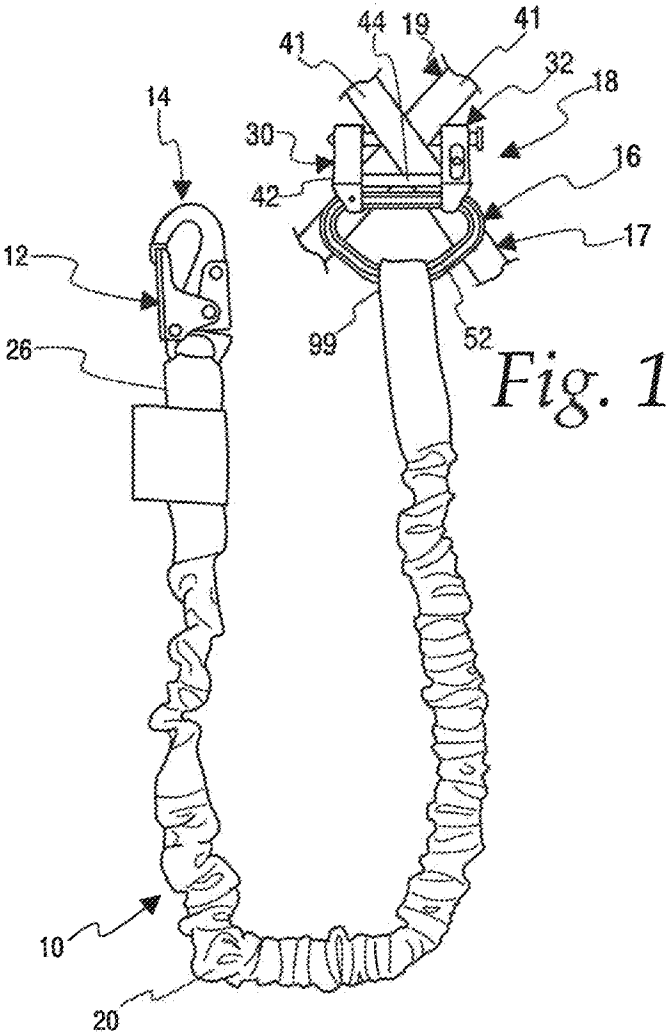

In the embodiment of the lanyard 10 shown in FIG. 1, the length of flexible, load bearing webbing 20 extends from the connector 12 to the connector 16 and has a looped end 99 fixed to the D-ring 52 of the connector 16.

In the embodiment of the lanyard 10 shown in FIG. 2, the lanyard 10 includes an energy absorber 100 having a looped end 102 fixed to the D-ring 52 of the connector 16 and a looped end 104 fixed to a looped end 106 of the length of flexible, load bearing webbing 20.

In both embodiments of the lanyard 10 shown in FIG. 1, the pins 56 are configured to withstand a maximum anticipated shock load so that the D-ring 52 remains fixed to the frame 30 of the connector 16 under all anticipated load conditions for the lanyard 10. In the embodiment of FIG. 2, the D-ring 52 is formed as part of a unitary, one piece frame 30, which is configured to withstand all anticipated load conditions for the lanyard 10.

Figure 4:
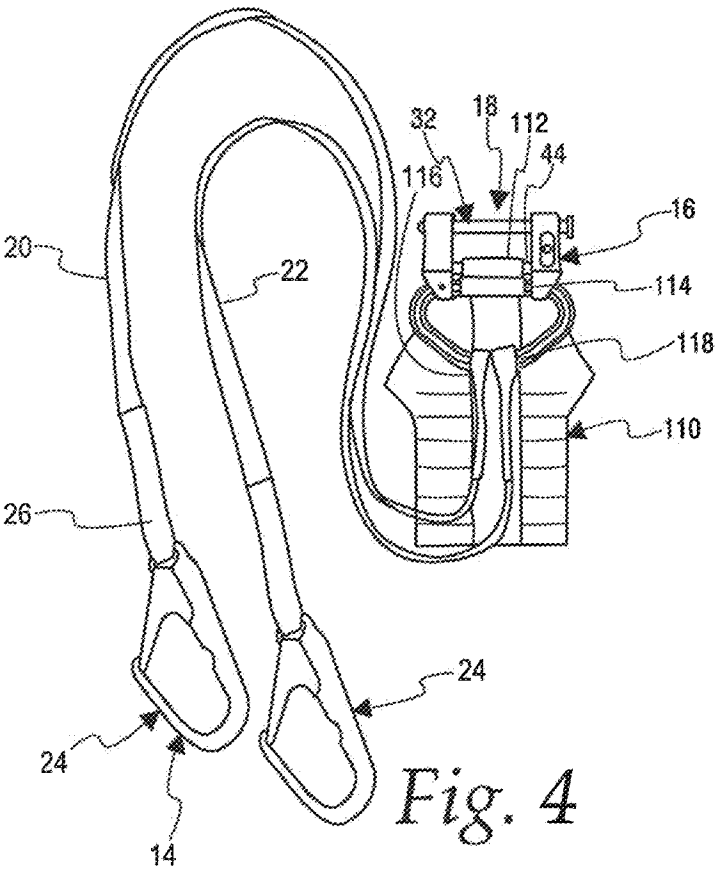
Figure 3:
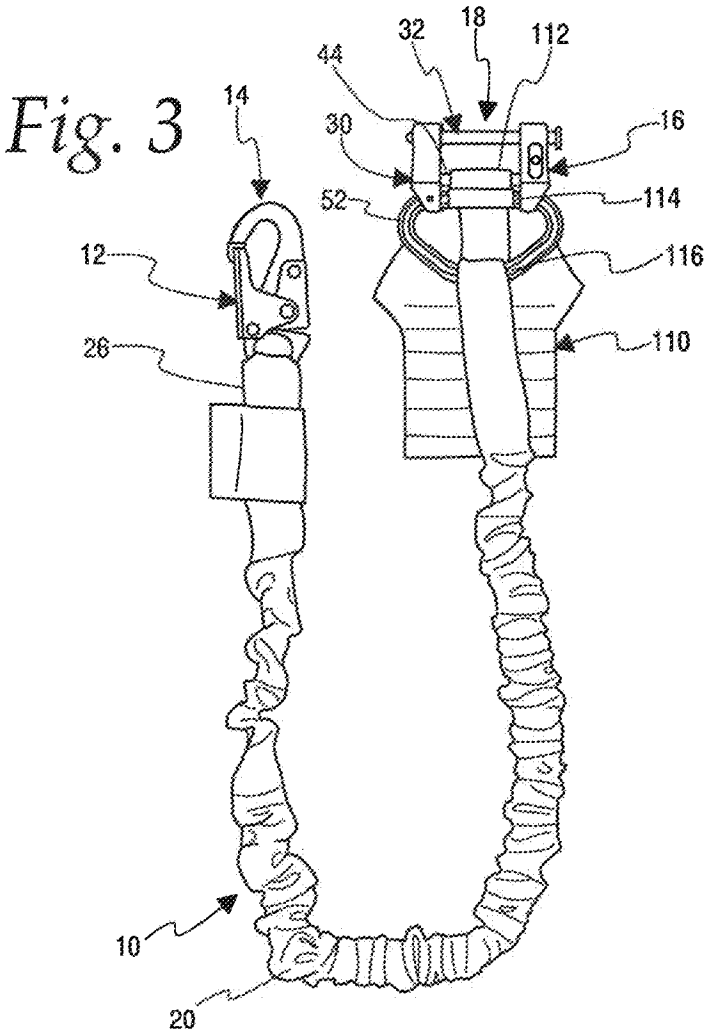
Figure 6:
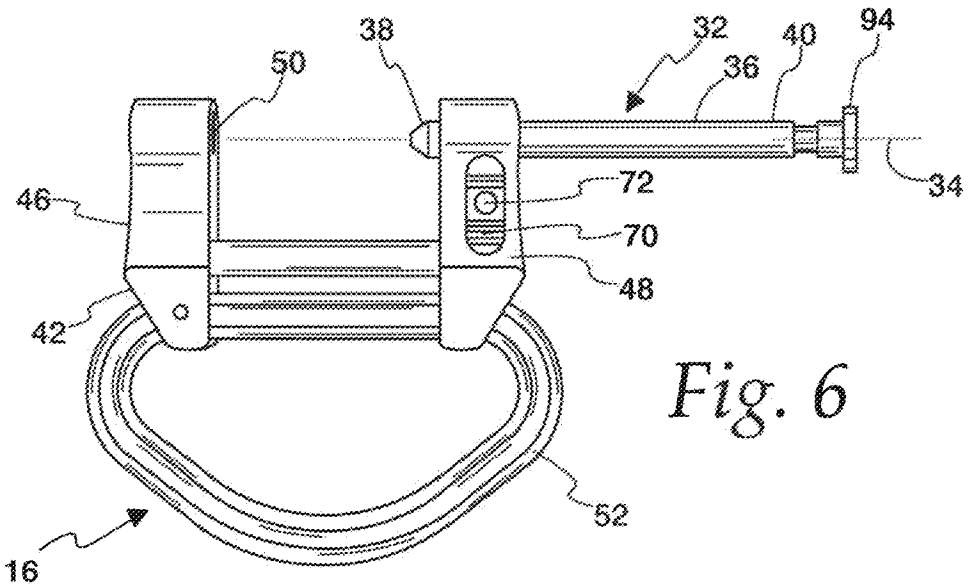
FIG. 6 is a view similar to FIG. 5, but showing the connector in an open condition.
Figure 5:
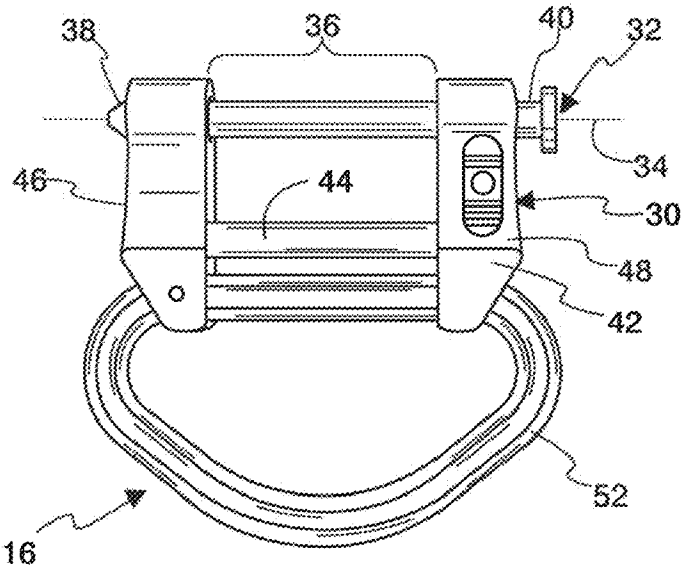
FIG. 5 is an elevation view of a connector utilized in the lanyard according to this disclosure, with the connector in a closed condition.

In the embodiments of the lanyard 10 shown in FIGS. 3 and 4, an energy absorber 110 has a looped end 112 fixed to the cross bar 44, and another looped end 114 fixed to the D-ring 52 between the leg portions 46 and 48. The length of flexible, load bearing webbing 20 has a looped end 116 fixed to the D-ring 52 in both embodiments, and the length of flexible, load bearing webbing 22 also has a looped end 118 fixed to the D-ring 52 in the embodiment of FIG. 4. In both embodiments, the pins 56 are configured as shear pins 56 that will break when subjected to forces that exceed a predetermined shock load on the D-ring 52 to allow the D-ring 52 to separate from frame 30 so that the energy absorber 110 can absorb further energy from a fall event while transmitting load between the frame 30 and the webbing 20, 22.

In the illustrated embodiments, the shock absorbers 100 and 110 are both known configurations wherein breakable connections that join load bearing webbing portions and absorb energy when the load bearing webbing portions are separate under load, breaking the connections. While such shock absorbers will be desirable in many applications, it should be understood that this disclosure contemplates that other suitable shock absorbers could me utilized in the lanyards 10, and that no limit to a specific configuration is intended unless expressly recited in an appended claim.

It should also be understood that while specific geometries and shapes have been illustrated for the components of the connectors 12 and 16, this disclosure contemplates that other geometries and shapes can be utilized with the lanyards 10 and that no limitation to a specific geometry or shape is intended unless expressly recited in an appended claim.

It should be appreciated that the lanyards 10 disclosed herein allow the lanyard 10 to be connected to a user's fall protection harness without connection to a D-ring of the user's harness, which allows the D-ring of the user's fall protection harness to be free for connection to other fall protection equipment.

The invention claimed is:

1. A fall arrest lanyard for arresting the fall of a user from an elevated worksite, the fall arrest lanyard comprising:

a first connector at a first end of the lanyard to connect the lanyard to an anchor point;

a second connector at a second end of the lanyard to connect the fall arrest lanyard to a harness worn by a user, the second connector comprising:

a rigid frame comprising an H-shaped bracket having a cross-bar portion extending between two leg portions;

a ring fixed to the rigid frame, the ring fixed to each of the two leg portions by shear pins configured to break when subjected to a force exceeding a predetermined threshold; and a load bearing pin extending along a longitudinal axis, the pin having a central span extending between first and second end portions, the pin mounted in the frame to translate along the longitudinal axis relative to the frame between an open position wherein at least one of the end portions is spaced from the frame to allow a length of webbing from a fall protection harness to be loaded into the connector for engagement with the central span of the pin and a closed position wherein the first and second end portions of the pin are supported by the frame with the central span of the pin being free from engagement to trap the length of webbing between the pin and the frame for load bearing engagement with the central span;

an energy absorber having an end fixed to the cross-bar portion of the rigid frame and another end fixed to the ring; and a length of flexible, load bearing, lanyard material extending between the first and second ends and having an end fixed to the ring and an opposite end fixed to the first connector.

2. The lanyard of claim 1 wherein the length of flexible, load bearing, lanyard material is a length of webbing.

3. The lanyard of claim 1 wherein the first connector comprises a snap hook.

4. The lanyard of claim 1 wherein one of the two leg portions supporting the first end portion of the pin and the other of the legs supporting the second end portion of the pin in the closed position.

5. The lanyard of claim 4 wherein the each of the leg portions has a bore receiving the corresponding end portion of the pin.

6. The lanyard of claim 4 wherein the pin is a cylindrical pin and the bores are cylindrical bores.

7. The lanyard of claim 4 wherein the leg portions extend parallel to each other and perpendicular to the cross-bar portion.

8. The lanyard of claim 4 wherein the cross-bar portion and the pin extend parallel to each other.

9. The lanyard of claim 1, further comprising:

another length of flexible, load bearing, lanyard material, having an end fixed to the ring and an opposite end fixed to a third connector.

* * * * *